US007194985B2

(12) United States Patent
Wachigai et al.

(10) Patent No.: US 7,194,985 B2
(45) Date of Patent: Mar. 27, 2007

(54) ENGINE COOLING STRUCTURE, AND ENGINE INCORPORATING SAME

(75) Inventors: Karou Wachigai, Saitama (JP); Kenji Oki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/227,893

(22) Filed: Sep. 15, 2005

(65) Prior Publication Data

US 2006/0065215 A1 Mar. 30, 2006

(30) Foreign Application Priority Data

Sep. 30, 2004 (JP) ..... 2004-288195

(51) Int. Cl.
*F01P 7/14* (2006.01)
*F01P 5/10* (2006.01)
*F02B 67/00* (2006.01)

(52) U.S. Cl. ..... 123/41.1; 123/41.44; 123/195 C; 123/195 A

(58) Field of Classification Search ..... 123/41.08, 123/41.09, 41.1, 195 R, 195 C, 195 A, 41.44
See application file for complete search history.

(56) References Cited

U.S. PATENT DOCUMENTS 2,852,009 A * 9/1958 Turlay ..... 123/41.1
6,101,995 A * 8/2000 Itoh et al. ..... 123/195 A
6,112,706 A * 9/2000 Heer ..... 123/41.1
6,260,515 B1 * 7/2001 Tosaka et al. ..... 123/41.08
2002/0073951 A1 * 6/2002 McClure ..... 123/195 C
2003/0029394 A1 * 2/2003 Miyagawa et al. ..... 123/41.54

FOREIGN PATENT DOCUMENTS

JP 2002-021562 1/2002

* cited by examiner

*Primary Examiner*—Noah P. Kamen
(74) *Attorney, Agent, or Firm*—Carrier, Blackman & Associates, P.C.; William D. Blackman; Joseph P. Carrier

(57) ABSTRACT

An engine cooling structure for a water cooled engine includes water pump and a thermostat. The water pump pumps coolant to a water jacket of the engine. The water pump and thermostat are provided on a cover member installed on an outside of a crankcase of the engine, and a coolant passage, which communicates with the water jacket through the water pump from the thermostat, is integrally formed in the cover member, so as to obtain arrangement of the cooling structure that is efficient in terms of space. The engine cooling structure increases the degree of freedom of layout around a cylinder head by keeping the projection amount on a side of the cylinder head small, simplifies the piping construction, and reduces the number of assembly steps.

20 Claims, 13 Drawing Sheets

ENGINE COOLING STRUCTURE, AND ENGINE INCORPORATING SAME

CROSS-REFERENCE TO RELATED APPLICATIONS

The present invention claims priority under 35 USC 119 based on Japanese patent application No. 2004-288195, filed on Sep. 30, 2004. The subject matter of this priority document is incorporated by reference herein.

BACKGROUND OF THE INVENTION

1. Field of the Invention

The present invention relates to an engine cooling structure used in a water-cooled engine for a motorcycle or the like. More particularly, the present invention relates to an engine cooling structure including a water pump for pumping coolant to a water jacket of the engine, and a thermostat which switches channels through which the coolant is routed on its way back from the water jacket to the water pump, according to the temperature of the coolant.

2. Background Art

Water cooled engines are well known. One known engine cooling structure used in a water-cooling engine has a configuration including: a water pump pumping coolant to the water jacket of the engine; a main circulation channel for returning the coolant which has passed through the water jacket to the water pump through a radiator; a bypass channel for returning the coolant which has passed through the water jacket to the water pump not through the radiator; and a thermostat which switches the channel for returning the coolant to the water pump between the main circulation channel and the bypass channel according to the temperature of the coolant, the thermostat being provided at a position close to the water pump.

In addition, in this kind of an engine cooling structure for a motorcycle, one structure has been proposed in which the water pump is disposed on a side of a cylinder head of the engine on the same axis as the cam shaft, and in which the thermostat is disposed at a position close to the water pump with the axis direction thereof directed orthogonal to the axis direction of the water pump. This engine cooling structure is disclosed, for example, in Japanese Patent Laid-Open Publication No. 2002-021562.

However, the above-described cooling structure is problematic since, by mounting the cooling structure at this location, the cooling structure projects outwardly from the vehicle body. The projection amount on the side of the cylinder head becomes large, and the degree of freedom of layout around the cylinder head therefore decreases.

In order to solve such a problem, it has been suggested to dispersedly arrange component parts, such as the water pump and the thermostat, around a crankcase.

However, if the positions of the water pump and the thermostat are merely moved to the periphery of the crankcase, the distance between the water pump or the like and the water jacket becomes large, and the piping construction installed around the engine becomes complicated. Thus, a new problem arises that the number of assembly steps for installing piping increases. In addition, it is conceivable that, as a result of laying out the exhaust pipe so as to avoid interference between component parts of the vehicle body such as the exhaust pipe and the water pump, the exhaust pipe affects the banking angle of the vehicle body.

An object of the present invention concerns solving the above-described problem. An engine cooling structure is provided which can increase the degree of freedom of layout around a cylinder head by keeping the projection amount on a side of the cylinder head small, does not cause complication in the piping construction, and can achieve reduction in the number of assembly steps. Moreover, an object of the present invention is to provide the engine cooling structure in which the water pump and the like do not interfere with the layout of the exhaust pipe, and which makes it easy to arrange the exhaust pipe in such a manner that the exhaust pipe does not affect the banking angle of the vehicle body.

SUMMARY OF THE INVENTION

In order to achieve the above-described object, a first aspect of the invention is an engine cooling structure including a water pump pumping coolant to a water jacket of an engine. The engine cooling structure includes a main circulation channel for returning the coolant which has passed through the water jacket to the water pump through a radiator, and a bypass channel for returning the coolant which has passed through the water jacket to the water pump not through the radiator. The engine cooling structure also includes a thermostat which switches the channel for returning the coolant to the water pump between the main circulation channel and the bypass channel according to a temperature of the coolant, the thermostat being provided at a position close to the water pump. The engine cooling structure is characterized in that the water pump and the thermostat are provided on a cover member installed on an outside of a crankcase of the engine, and a coolant passage, which communicates with the water jacket through the water pump from the thermostat, is integrally formed in the cover member. The coolant discharged from the water pump is pumped to the water jacket through the coolant passage.

A second aspect of the invention is characterized in that, in addition to the construction of the invention according to the first aspect of the invention, a transmission for transmitting power from the engine to a driving wheel is disposed on a first end side of a crankshaft of the engine, and a generator generating electricity by rotation of the crankshaft is disposed on an opposed, second end side of the crankshaft. The water pump is disposed on the second end side of the crankshaft and below the generator.

A third aspect of the invention is characterized in that, in addition to the construction of the invention according to first or second aspects thereof, the coolant passage is composed of a first passage, which makes the thermostat communicate with a suction port of the water pump, and a second passage, which makes a discharge port of the water pump communicate with the water jacket. In addition, the water pump is disposed below and to the front, in terms of a vehicle body, of the crankshaft of the engine, and the thermostat is disposed above and to the front, in terms of the vehicle body, of the water pump. The first passage is so disposed that the first passage overlies the second passage when viewed from a side.

A fourth aspect of the invention is characterized in that, in addition to the construction of the invention according to any one of first to third aspects thereof, an exhaust pipe extending from the engine is close to and overlies the first passage when viewed from a side, overlaps the thermostat in the vertical direction, and is disposed in a position along a vehicle body lower surface which is substantially parallel with the banking angle.

With the engine cooling structure of the first aspect of the invention, since the positions of the water pump and the thermostat for circulating the coolant have been moved to the outside of the crankcase of the engine, where it is easy to secure the required mounting space, it is possible to make the space occupied by the cooling structure itself compact. Accordingly, as compared to the conventional cooling structure, in which the water pump and the thermostat are disposed on a side of the cylinder head, the cooling structure can increase the degree of freedom of layout around the cylinder head by keeping the projection amount on the side of the cylinder head small.

Moreover, in the engine cooling structure of the first aspect of the invention, the water pump and the thermostat are provided on the cover member installed on the outside of the crankcase of the engine. In addition, the coolant passage, which communicates with the water jacket through the water pump from the thermostat, is integrally formed in the cover member. Thus, the need for the work of, for example, connecting a pipe or the like to be the coolant channel to the water pump inside the cover member is eliminated, complication in the piping construction is prevented, and the number of assembly steps is reduced.

In the case of an engine for a motorcycle, many components for changing speed are installed on the transmission side thereof, the transmission being connected to one end of the crankshaft, and it is therefore difficult to preserve room therearound. In comparison with this, the generator, connected on the other end of the crankshaft, is small as compared to the transmission, and room is therefore left therearound, particularly therebelow.

In other words, with the engine cooling structure of the second aspect of the invention, the room below the generator is effectively utilized as a space for disposing the water pump, and the cooling structure is arranged efficiently in terms of space.

With the engine cooling structure of the third aspect of the invention, the first and second passages to be the coolant passage are arranged compactly, and it is therefore possible to prevent the enlargement of the cover member and reduce the amount of space occupied.

With the engine cooling structure of the fourth aspect of the invention, the water pump, the thermostat, and the like do not interfere with the layout of the exhaust pipe, and it is possible to place the exhaust pipe within such a region that does not affect the banking angle of the vehicle body. Thus, the layout design of the exhaust pipe is simplified.

For a more complete understanding of the present invention, the reader is referred to the following detailed description section, which should be read in conjunction with the accompanying drawings. Throughout the following drawings and description, like numbers refer to like parts. The above-mentioned object, other objects, characteristics and advantages of the present invention will become apparent form the detailed description of the embodiment of the invention presented below in conjunction with the attached drawings.

DETAILED DESCRIPTION OF THE INVENTION

A detailed description will be given below of a preferred embodiment of an engine cooling structure according to the present invention with reference to the drawings.

FIGS. 1 to 13 show a motorcycle incorporating a cooling structure according to a first embodiment of the present invention.

Figure 1:
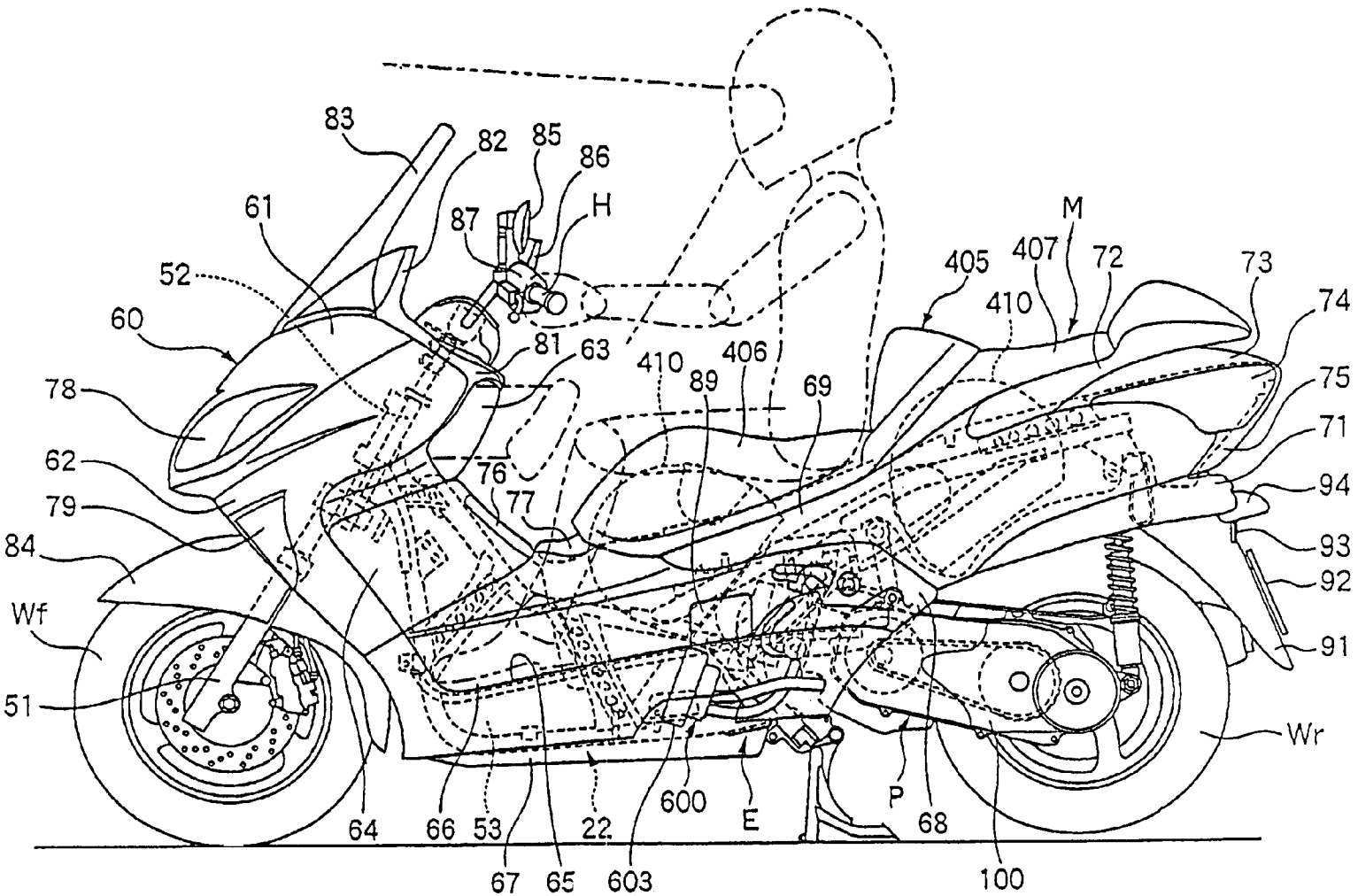
FIG. 1 is a side plan view of a motorcycle on which a cooling structure of an engine according to the present invention is mounted.

In the scooter-type motorcycle M shown in FIG. 1, a swing-type power unit P is disposed at a position which is below a seat 405, and which is between a front wheel Wf steered by a steering handle H and a rear wheel Wr, which is a driving wheel.

A body frame 22 of the motorcycle M includes, at the front end thereof, a front fork 51 rotatably supporting the front wheel Wf and a head pipe 52 pivotally and steerably supporting the steering handle H connected to the front fork 51. In addition, the power unit P, supporting the rear wheel Wr at the rear end of the body frame 22, is pivotally supported in the middle portion in the fore-and-aft direction of the body frame 22, so as to be swingable in the vertical direction. In addition, a fuel tank 53, and a radiator 603 disposed to the rear of the fuel tank 53, are mounted in a portion of the body frame 22 that is in front of the power unit P. A riding seat 405 is located on the rear portion of the body frame 22. The riding seat 405 has a tandem configuration with a rider seat 406 in the front thereof and a passenger seat 407 in the rear thereof. Moreover, a body cover 60 made of synthetic resin is attached to the body frame 22, the body cover 60 covering the body frame 22, the engine E, the fuel tank 53 and the radiator 603.

The body cover 60 includes a front cover 61 covering the front of the head pipe 52 and the upper side of the front wheel Wf, a left-right pair of front side covers 62, which are joined to both left and right sides of the front cover 61, respectively, and an inner cover 63, which is joined to the front side covers 62 in such a manner that the inner cover 63 covers the head pipe 52 from the rear thereof. The body cover 60 includes a leg shield 64, which is joined to the front side covers 62 and the inner cover 63 in such a manner that the leg shield 64 covers the front of the legs of a rider riding on the rider seat 406, a left-right pair of floor center covers 66, which are joined to the leg shield 64 and extend rearward, and each bottom portion of which forms a step floor 65, a left-right pair of floor side cover 67, each suspended downward from the outer edge of the step floor 65, and a left-right pair of passenger steps 68, each provided to the rear of the step floor 65.

The body cover 60 further includes a left-right pair of body side covers 69, which are disposed below both sides of the riding seat 405, and each of which is installed consecutively to each floor side cover 67 and extends rearward. The body cover 60 includes a rear lower cover 71 installed consecutively to the rear, lower portion of the body side covers 69, a rear upper cover 73 disposed to the rear of a glove rail 72, and a rear center cover 75, which is disposed between a left-right pair of tail lamp units 74 and is joined to the rear upper cover 73.

Moreover, the vehicle body 60 has a filler lid 76 attached thereto openably and closably. The filler lid 76 covers a filler cap on the top of the fuel tank 53. The vehicle body has a hinge cover 77 covering a hinge portion of the rider seat 406 for a luggage space 420. In addition, head lights 78 are disposed between each side of the front of the front cover 61 and the corresponding front portion of the left-right pair of front side covers 62, respectively. Winkers 79 are disposed in the front of the front side covers 62 under the head lights 78, respectively. In addition, a panel 81 for arranging meters is joined to the upper portions of the front cover 61 and the inner cover 63, a meter visor 82 is integrally provided to the front of the panel 81, and a windshield 83 is disposed in front of the meter visor 82.

In addition, a front fender 84 covering the front wheel Wf from above is supported by the front fork 51. A left-right pair of rear view mirrors 85, an audio control switch case 86, a switch case 87 for controlling lamps and the like, and the like are attached to the steering handle H. In addition, a maintenance lid 89 for spark plugs is openably and closably attached to the floor center cover 66 to the front of the passenger step 68. In addition, a license plate 92, a reflector 93, and a license-plate light 94 are attached to a rear fender 91 covering the rear wheel Wr from the rear thereof.

Figure 2:
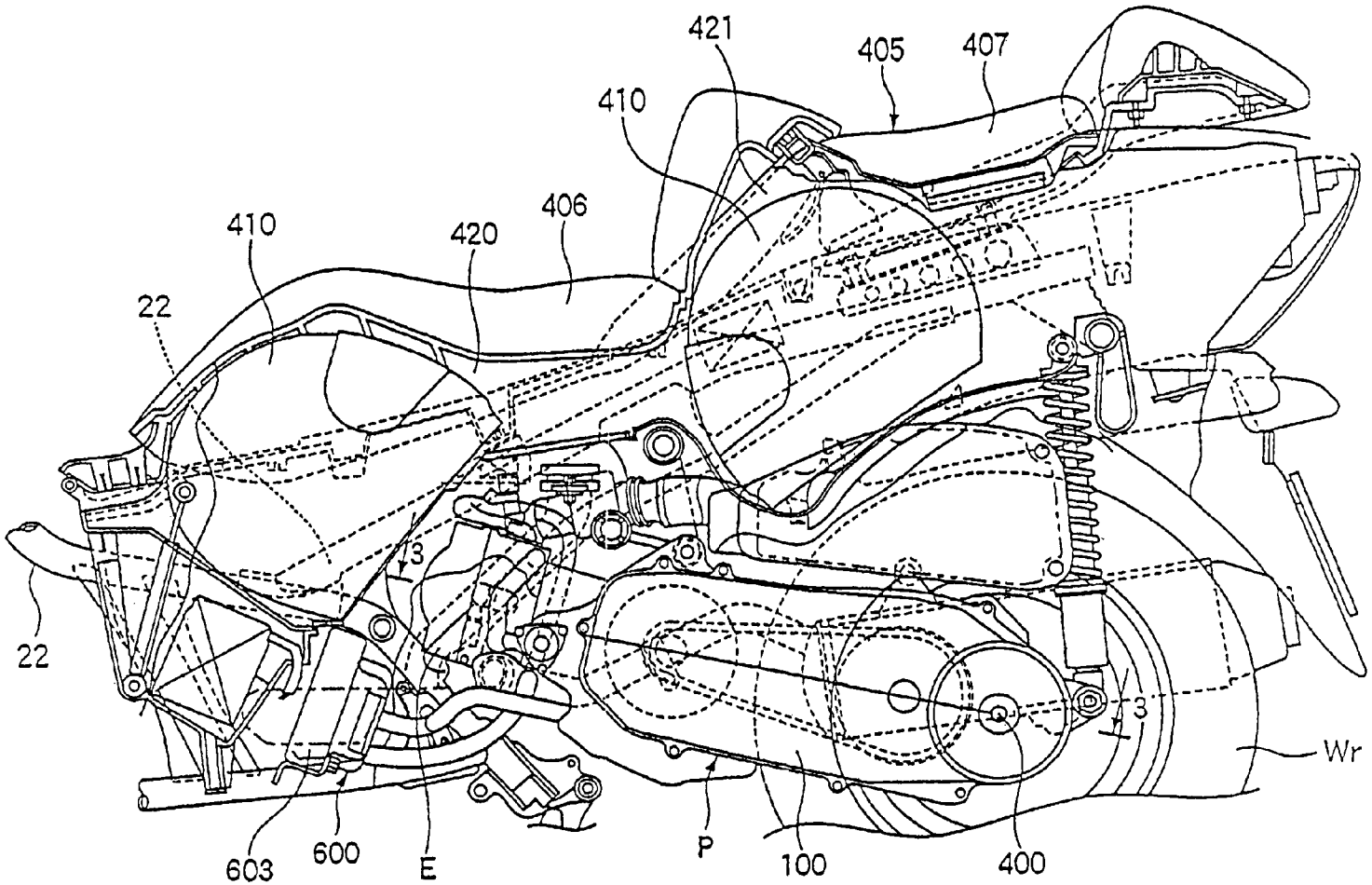
FIG. 2 is a enlarged detail view of the motorcycle of FIG. 1, showing an engine which is a component of the motorcycle, and showing the position of a second cooling structure with respect to the engine and body frame.

In addition, as shown in FIG. 2, two luggage spaces 420, 421, each of which is capable of accommodating a helmet 410, are secured in the region between the riding seat 405 and the power unit P.

Figure 3:
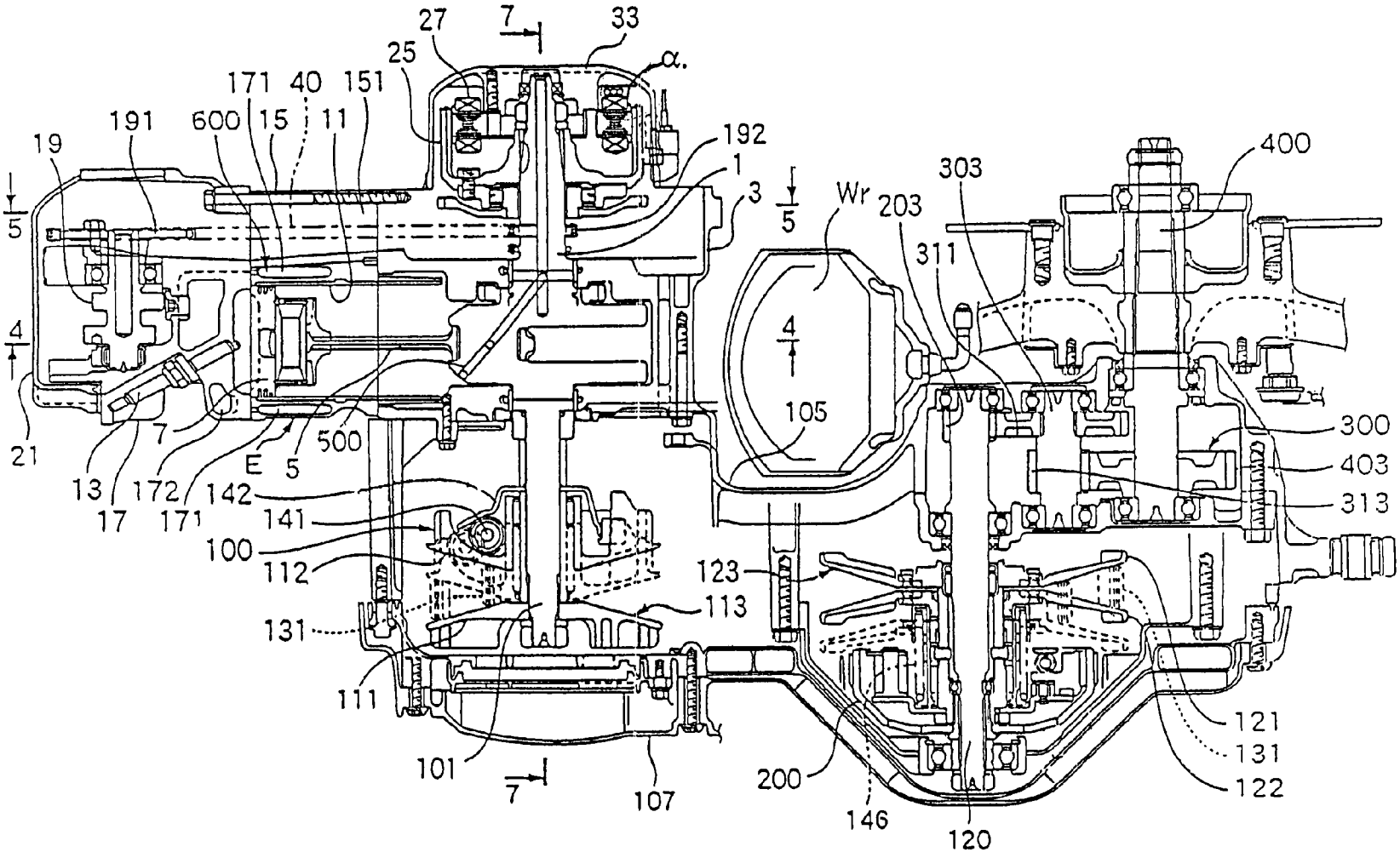
FIG. 3 is a cross-sectional view of the engine of FIG. 2, taken along line 3—3 and showing the crankshaft of the engine having a transmission mounted to a first end thereof and a generator mounted to a second end thereof, and showing the cylinder head lying generally forward of the crankshaft.

As shown in FIG. 3, the power unit P shown here transmits power from the water-cooled engine E to an axle 400 of the rear wheel Wr, which is a driving wheel, via a belt-type continuously variable transmission 100, an automatic centrifugal clutch 200, and a speed reducer 300 using a train of gears.

Figure 4:
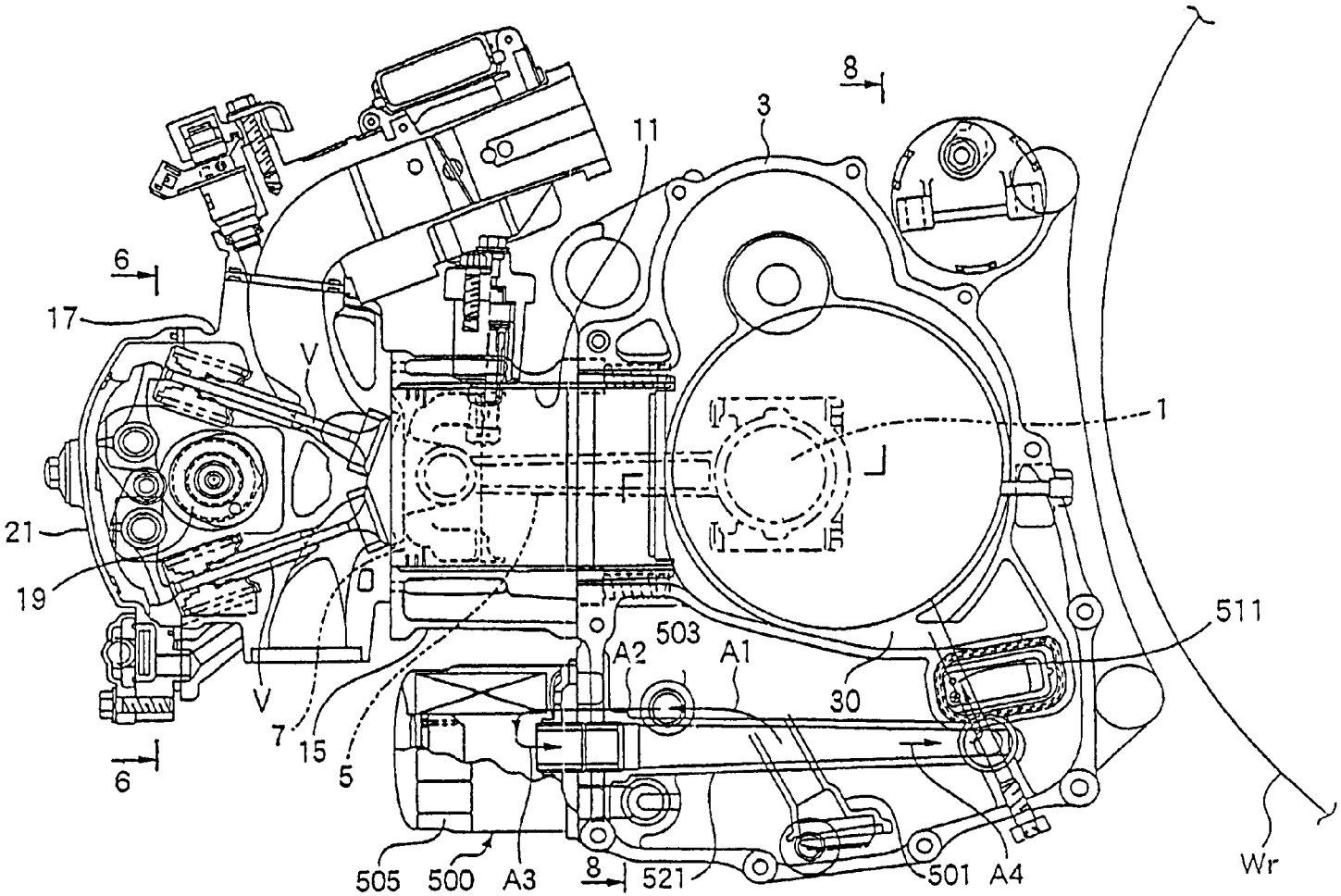
FIG. 4 is a cross-sectional view of the engine taken along line 4—4 of FIG. 3, showing the engine cylinder and cylinder head as viewed from the left side and showing the configuration of the first cooling structure.

As shown in FIGS. 3 and 4, the engine E includes a crankcase 3, which is a casing freely rotatably supporting a crankshaft 1. The crankcase 3 also houses a piston 7 connected to the crankshaft 1 via a connecting rod 5 and a cylinder block 15 joined to the front, in terms of the vehicle body, of the crankcase 3 and providing cylinder portions (combustion chambers) 11, in which the piston 7 is slidably fitted. The crankcase 3 houses a cylinder head 17 joined to the front, in terms of the vehicle body, of the cylinder block 15, to which valves V for air intake and exhaust to and from the cylinder portions 11 and spark plugs 13 are installed, and a head cover 21 covering the front, in terms of the vehicle body, of camshafts 19, which is built in the front, in terms of the vehicle body, of the cylinder head 17. The crankcase 3 further includes a first cooling structure 500 cooling the sliding portion in the crankcase 3 by the use of circulation of the lubricating oil; and a second cooling structure 600 cooling the engine by circulating the coolant in a water jacket 171, 172, which is provided to the cylinder head 17 and the head cover 21.

In addition, as shown in FIG. 3, a chain passage 151, in which a timing chain 40 is inserted, is provided in the rightmost side of the cylinder block 15. The timing chain 40 is looped over a sprocket 191 fixed on the right end of the camshaft 19 and a drive sprocket 192 provided to the crankshaft 1, and transmits the rotation of the crankshaft 1 to the camshaft 19 in such a manner that the camshaft 19 makes one revolution every two revolutions of the crankshaft 1.

Figure 5:
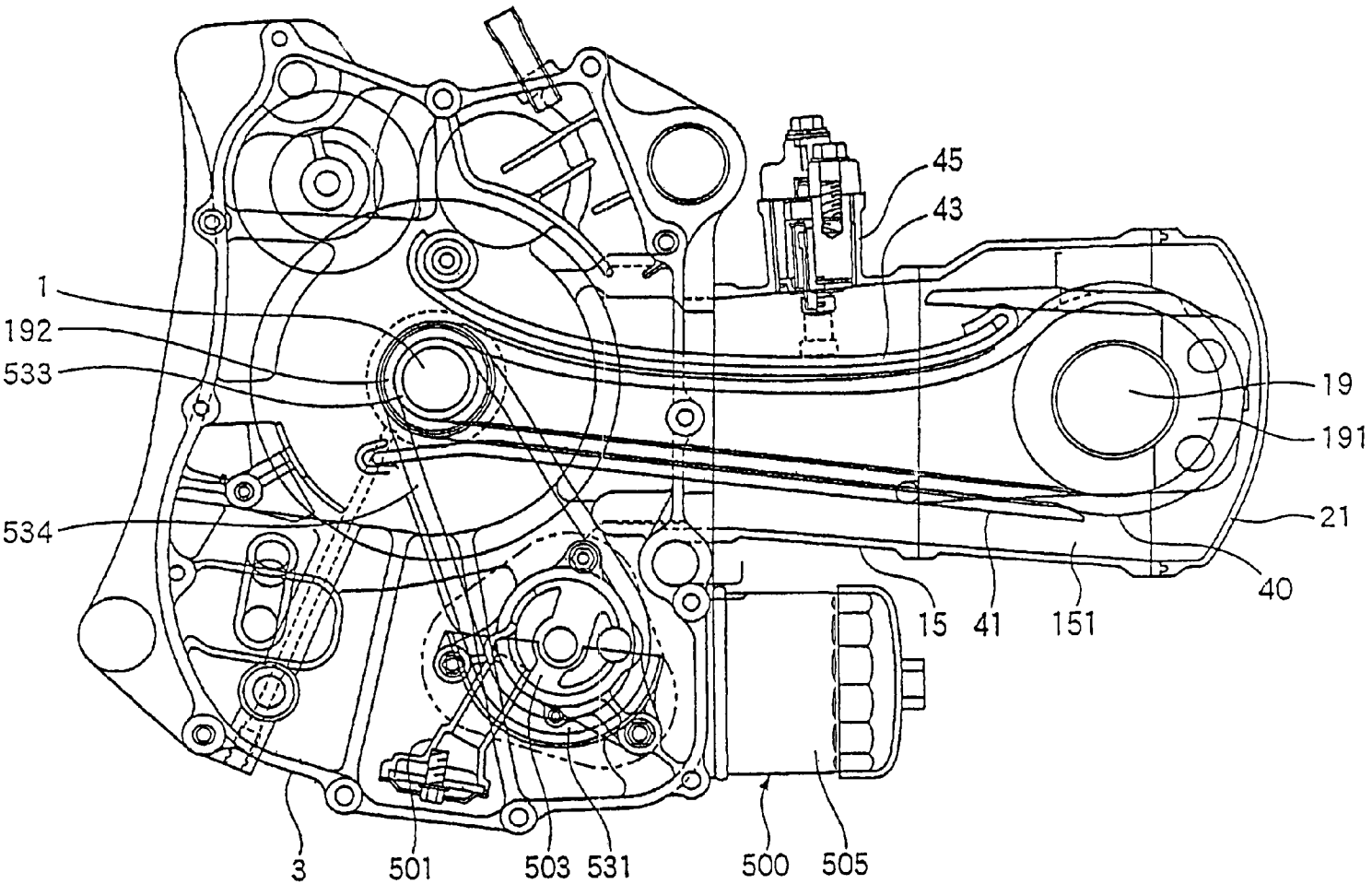
FIG. 5 is a cross-sectional view taken along line 5—5 of FIG. 3 showing the engine as viewed from the right side and showing the oil pump driven by the crankshaft.

As shown in FIG. 5, chain guides 41, 43 are in contact with the timing chain 40 from both sides thereof so as to maintain a certain tension. One chain guide 41 is fixed in the chain passage 151, while the other chain guide 43 is supported by a chain tensioner 45 movably forward and backward, thereby preventing slack in the timing chain 40 from occurring by adjusting the position of the chain guide 43 according to elongation of the timing chain 40.

The engine E of this embodiment is mounted with the axis of the crankshaft 1 directed in the body width direction, and is attached to the body frame 22 (see FIG. 2) in a position where the cylinder head 17 is directed toward the front of the vehicle body. In this engine E, as shown in FIG. 3, an outer rotor 25, which is a flywheel and a generator, is provided on the right end of the crankshaft 1, and a stator coil 27 of the generator is provided in the inner circumference of the outer rotor 25. The generator a generates electricity by rotation of the outer rotor 25 which rotates integrally with the crankshaft 1 to supply power to electric parts mounted on the vehicle and charge an in-vehicle battery. In addition, a right-side case cover 33 covering the outer rotor 25, which also is the flywheel, and the stator coil 27 of the generator a from the outside thereof is attached on the right face of the crankcase 3.

At the left end of the crankshaft 1, a primary shaft 101 is integrally formed, which is the input shaft of the belt-type continuously variable transmission 100. In addition, a case cover 107 covering a casing 105, which defines an accommodation portion 103 accommodating the belt-type continuously variable transmission 100, and the opening on the outside of the accommodation portion 103, is attached on the left face of the crankcase 3. It should be noted that a portion of a side of the crankcase 3 penetrated by the crankshaft 1 is sealed by use of a sealing ring, a packing or the like so as to prevent a spray of the lubricating oil in the crankcase 3 from entering into the accommodation portion 103.

The belt-type continuously variable transmission 100 includes a drive pulley 113 constituted of a fixed-side pulley half 111 and a movable-side pulley half 112 provided on the primary shaft 101. The transmission 100 includes a driven pulley 123 constituted of a fixed-side pulley half 121 and a movable-side pulley half 122 relatively rotatably provided to a secondary shaft 120, which is an output shaft. The transmission 100 also includes an endless belt 131 with a V-shaped cross section looped over the drive pulley 113 and the driven pulley 123, drive-side groove width changing means 142 impelling the movable-side pulley half 112 toward the fixed-side pulley half 111 by means of a centrifugal weight 141 moving radially outward in response to the increase of the rotational frequency of the crankshaft 1, and a pulley impelling spring 146 impelling the movable-side pulley half 122 toward the fixed-side pulley half 121 in such a manner that the groove width in the driven pulley 123 is adjusted, following the change of the groove width of the drive pulley 113. The belt-type continuously variable transmission 100 steplessly controls the transmission gear ratio by changing the groove width of the drive pulley 113 and the driven pulley 123 in response to the rotational frequency of the crankshaft 1.

For example, in the belt-type continuously variable transmission 100, when the groove width of the drive pulley 113 is reduced by radially outward movement of the centrifugal weight 141 following the increase of the rotational frequency of the primary shaft 101, the loop radius of the endless belt 131 on the drive pulley 113 is thereby increased. At this time, tension, by which the endless belt 131 is pulled toward the movable-side pulley half 112, is exerted on the endless belt 131, the movable-side pulley half 122 of the driven pulley 123 receiving the tension is displaced in such a direction that the movable-side pulley half 122 comes away from the fixed-side pulley half 121, opposing the impelling force of the pulley impelling spring 146, the driven pulley 123 changes to a state in which the groove width is widened, and the loop radius of the endless belt 131 on the driven pulley 123 is reduced. In this way, the groove width of the drive pulley 113 is reduced, and the widening of the groove width of the driven pulley 123 in response thereto makes the transmission gear ratio of the belt-type continuously variable transmission 100 large.

On the other hand, when the groove width of the drive pulley 113 is widened due to decrease of the rotational frequency of the primary shaft 101, the loop radius of the endless belt 131 on the drive pulley 113 is thereby reduced. The reduction in the loop radius of the endless belt 131 on the drive pulley 113 reduces the force acting on the movable-side pulley half 122 via the endless belt 131. Accordingly, the movable-side pulley 122 is pushed back toward the fixed-side pulley half 121 by the impelling force of the pulley impelling spring 146, and the loop radius of the endless belt 131 on the driven pulley 123 increases. In this way, the groove width of the drive pulley 113 is widened, and the reduction in the groove width of the driven pulley 123 in response thereto makes the transmission gear ratio of the belt-type continuously variable transmission 100 small.

When the rotational frequency of the driven pulley 123 becomes equal to or higher than a set rotational frequency, the automatic centrifugal clutch 200 provided to the secondary shaft 120 enables the power transmission from the secondary shaft 120 to the speed reducer 300 by integrally rotatably connecting the driven pulley 123 and the secondary shaft 120.

The speed reducer 300 has a configuration including: a reduction shaft 303 disposed between the secondary shaft 120 and the axle 400 in parallel with these shafts; a first reduction gear 311 provided on the reduction shaft 303 and engaging with an output gear 203 on the secondary shaft 120; and a second reduction gear 313 provided on the reduction shaft 303 and engaging with an input gear 403 on the axle 400. The speed reducer transmits the rotation of the secondary shaft 120 to the axle 400 with the rotational speed reduced by a predetermined reduction ratio.

In the first cooling structure 500 provided to the engine E, as shown in FIG. 5, a strainer 501 and an oil pump 503, which draws up the lubrication oil collected in an inner bottom portion of the crankcase, are disposed in a position which corresponds to the inner bottom portion of the crankcase when the engine E is mounted on a vehicle. The lubrication oil discharged from the oil pump 503 is filtered through an oil filter 505, and is thereafter supplied to an oil passage 513 in the crankshaft 1 through an oil passage 511 drilled in the crankcase 3, a balancer shaft 2 following the crankshaft 1 to be rotationally driven, and the like.

In FIG. 4, the arrow Al indicates the flow of the lubrication oil from the strainer 501 to the oil pump 503. The arrow A2 indicates the flow of the lubrication oil from the oil pump 503 to the oil filter 505. Reference numeral 521 indicates an oil passage introducing the lubrication oil which has passed through the oil filter 505 to the oil passage 511 drilled in the crankcase 3. The arrows A3 and A4 indicate the flow of the lubrication oil supplied to the oil passage 511 from the oil filter 505 through the oil passage 521.

Figure 7:
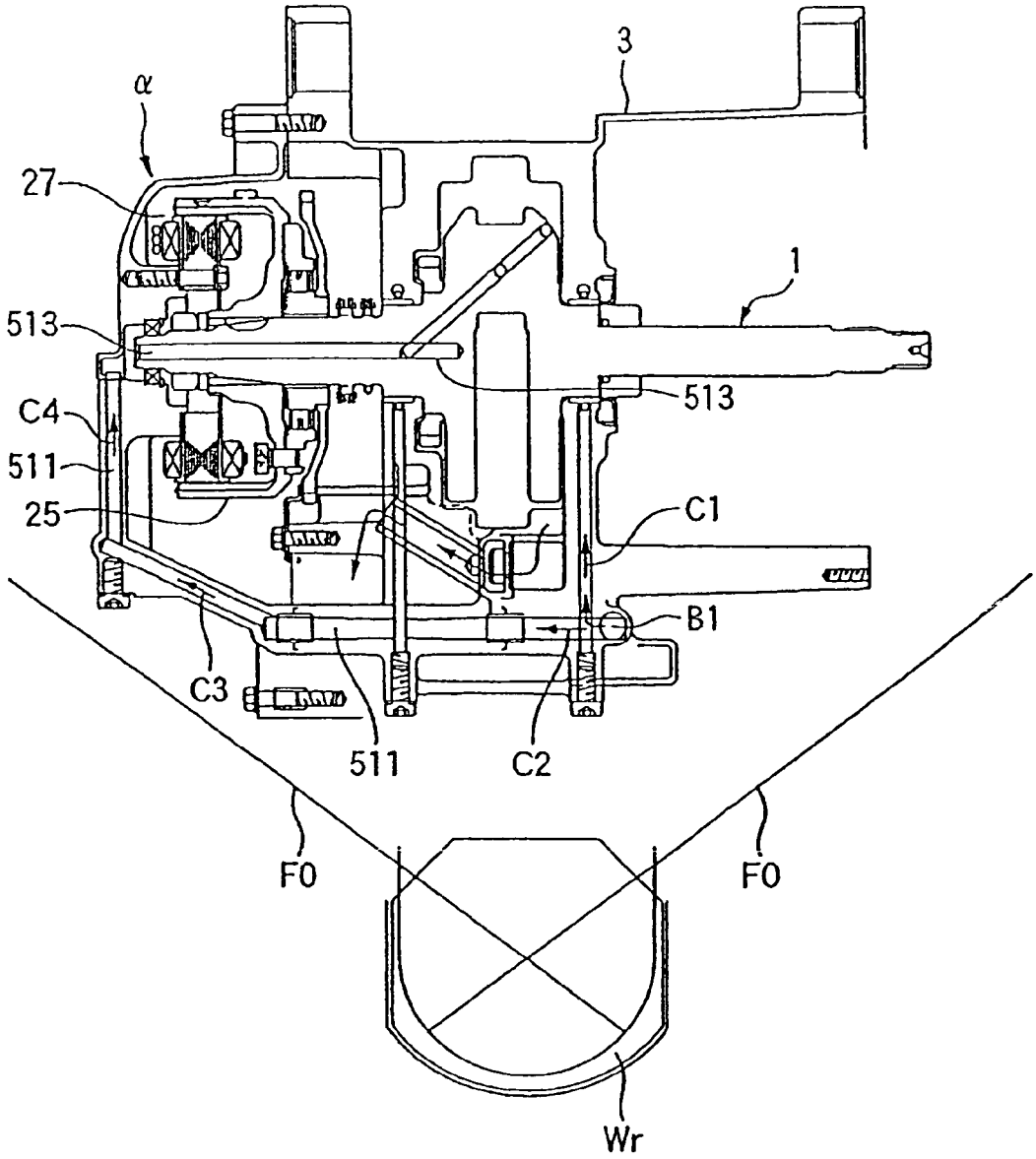
FIG. 7 is a cross-sectional view taken along line 7—7 of FIG. 3 showing the crankshaft of the engine as viewed from the front of the vehicle, and showing the location of the body lower surface with respect to the lower portion of the engine.

As shown in FIG. 7, the lubrication oil supplied to the oil passage 511 in the crankcase 3 passes, from the supply start point B1, through the oil passage 511 communicating therewith as shown by the arrows C1, C2 and C3, and is supplied to the oil passage 513 of the crankshaft 1 which communicates with the oil passage 511. Then, the lubrication oil supplied to the oil passage 513 of the crankshaft 1 is supplied by spraying from the opening end of the oil passage 513 to the surrounding portions, such as the balancer shaft 2 and the cylinder portion 11. The lubrication oil supplied by spraying goes back to the inner bottom potion of the crankcase 3 through a return passage formed in the inner surface of the crankcase 3. In the course back to the inner bottom portion of the crankcase 3, a reed valve is provided between an inside 30 of the crankcase 3 and the inner bottom portion thereof, so that the lubrication oil is discharged to the inner bottom portion of the crankcase by pressure increase in the inside 30 of the crankcase accompanying the descent of the piston 7, and backflow thereof to the inside 30 of the crankcase is prevented from occurring.

Figure 8:
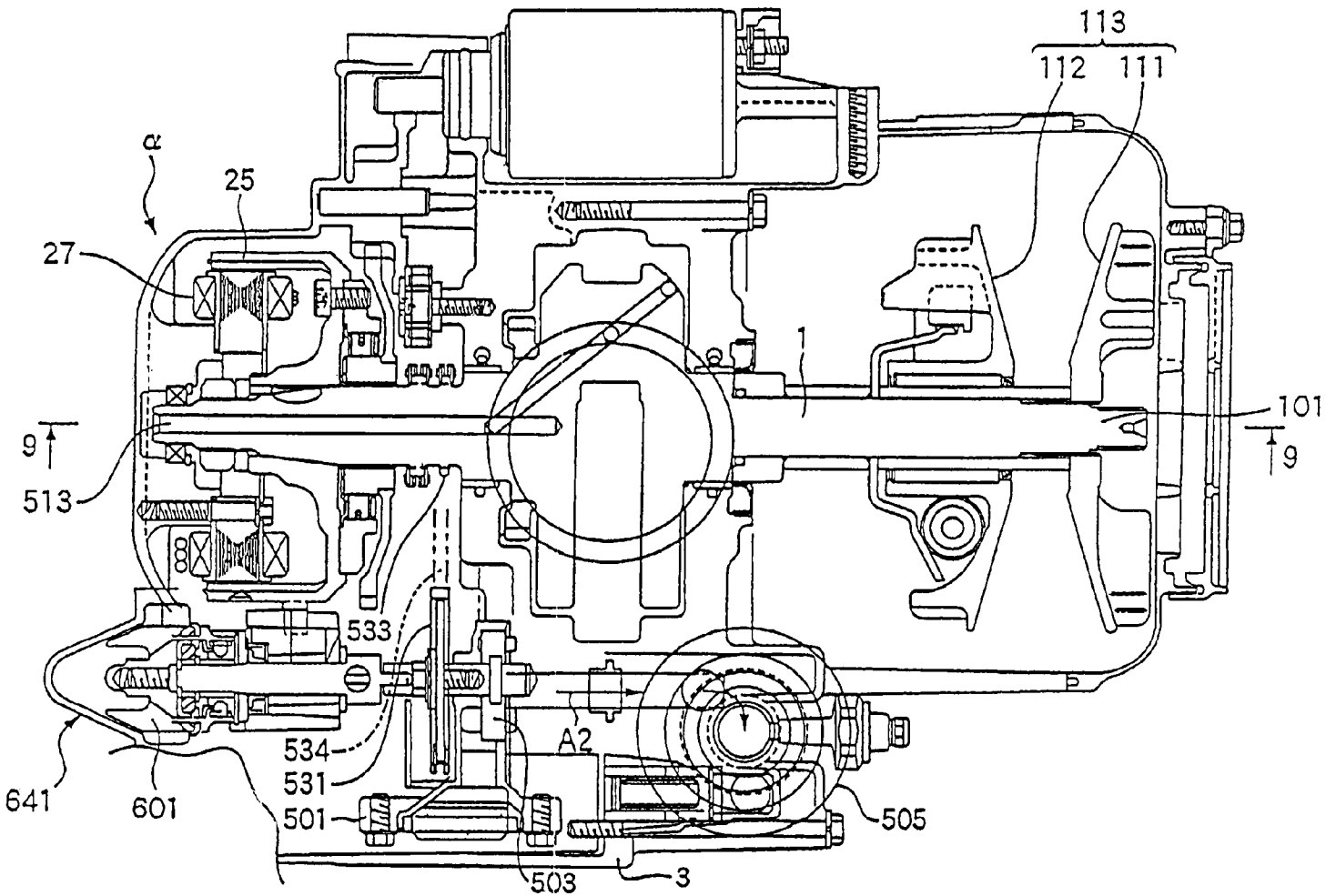
FIG. 8 is a cross-sectional view taken along line 8—8 of FIG. 4 showing the crankshaft of the engine as viewed from the front of the vehicle, and showing the water pump positioned below the generator, and showing the oil pump positioned below the generator at a location closer to the centerline of the engine than the water pump.
Figure 9:
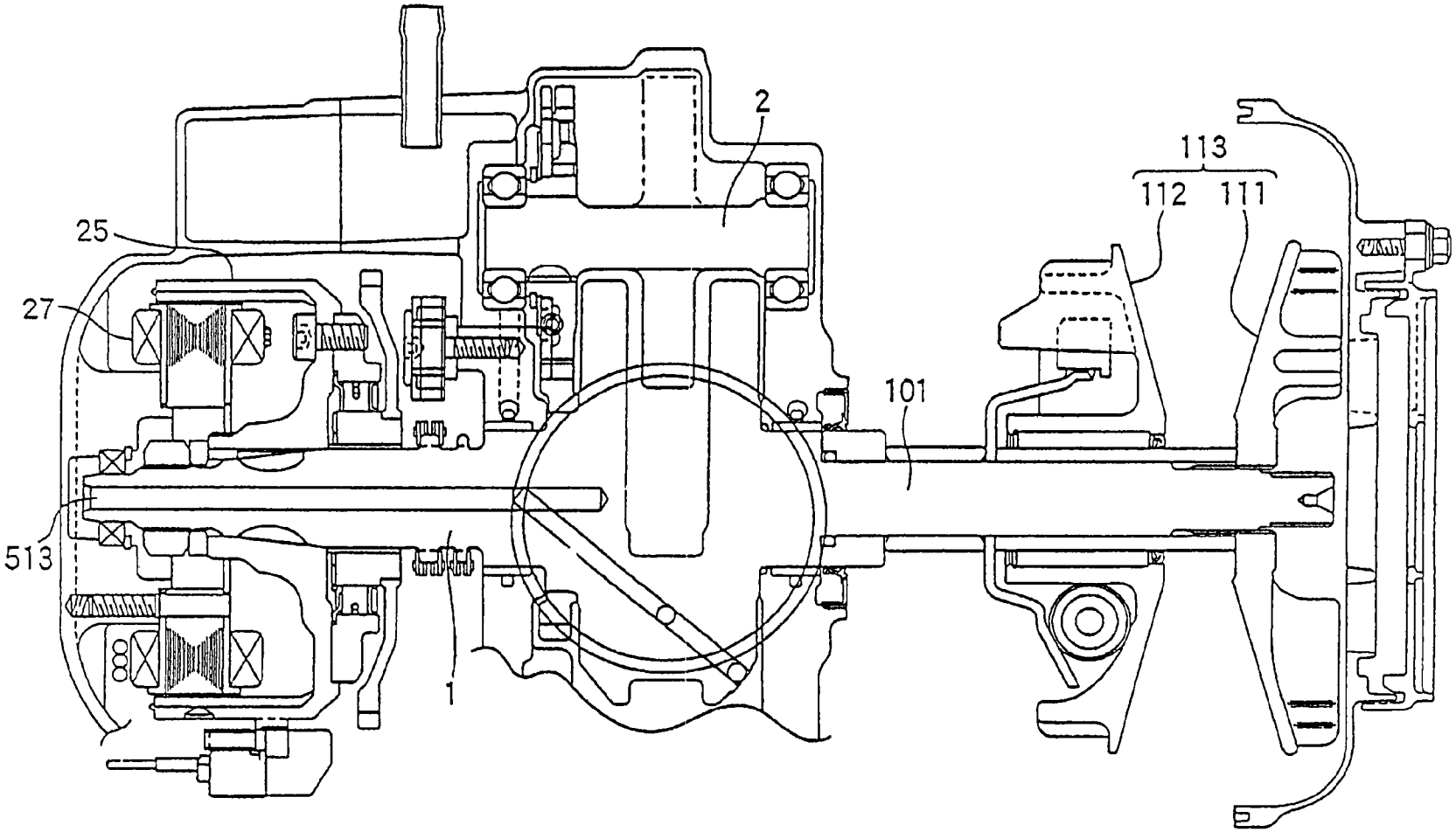
FIG. 9 is an enlarged cross-sectional view taken along line 9—9 of FIG. 8 showing the crankshaft of the engine as viewed from below showing the lubrication passageways therein.

With regard to the oil pump 503 used in the first cooling structure 500, as shown in FIGS. 5 and 8, the rotation of the crankshaft 1 is transmitted to the input shaft via sprockets 531, 533, and a chain or a belt 534. The oil pump 503 is therefore rotationally driven by the crankshaft 1.

Figure 10:
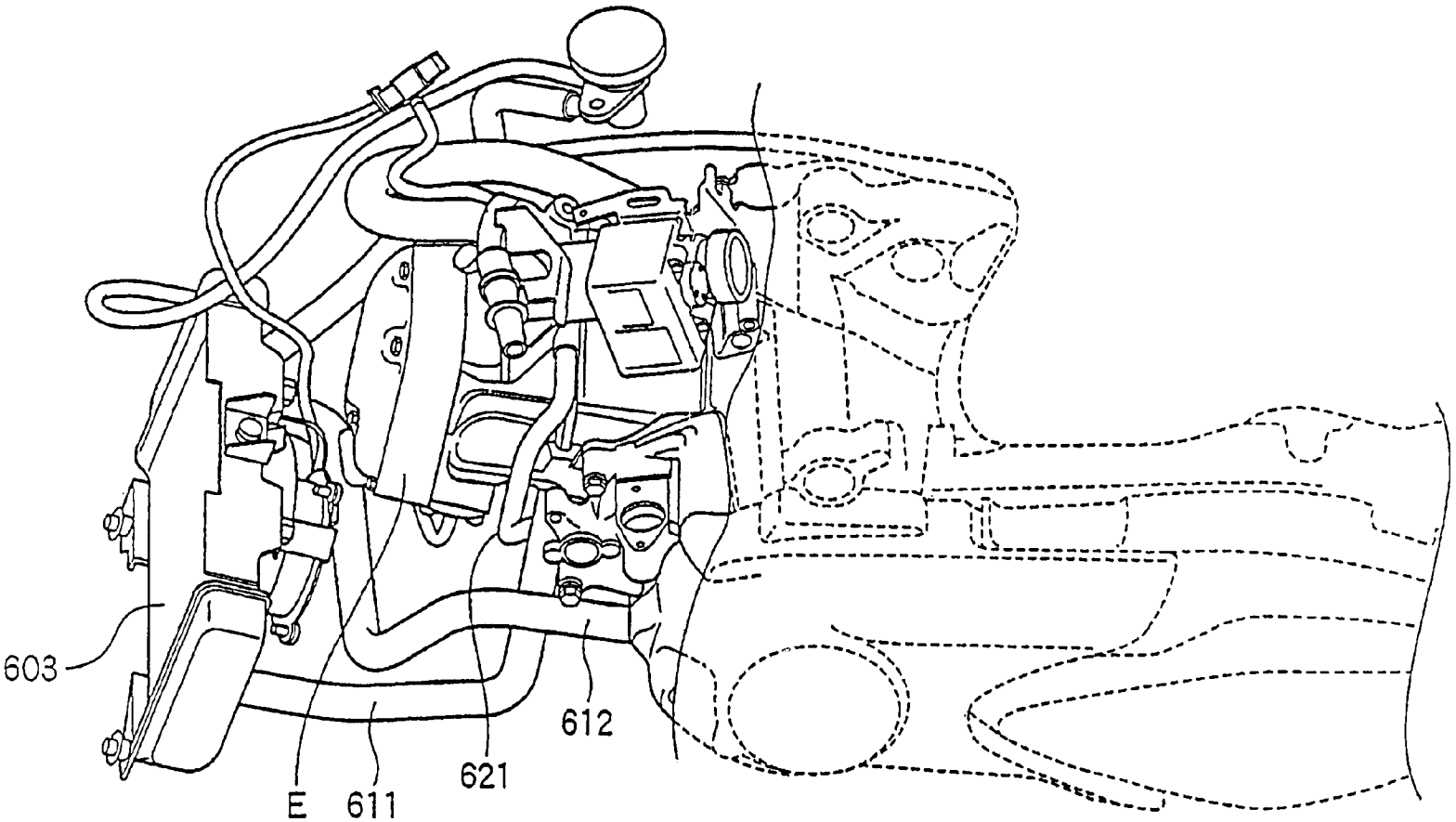
FIG. 10 is an enlarged perspective view of the water-cooling-engine cooling structure shown in FIG. 2, showing that the main channels overlap when viewed from the side.
Figure 11:
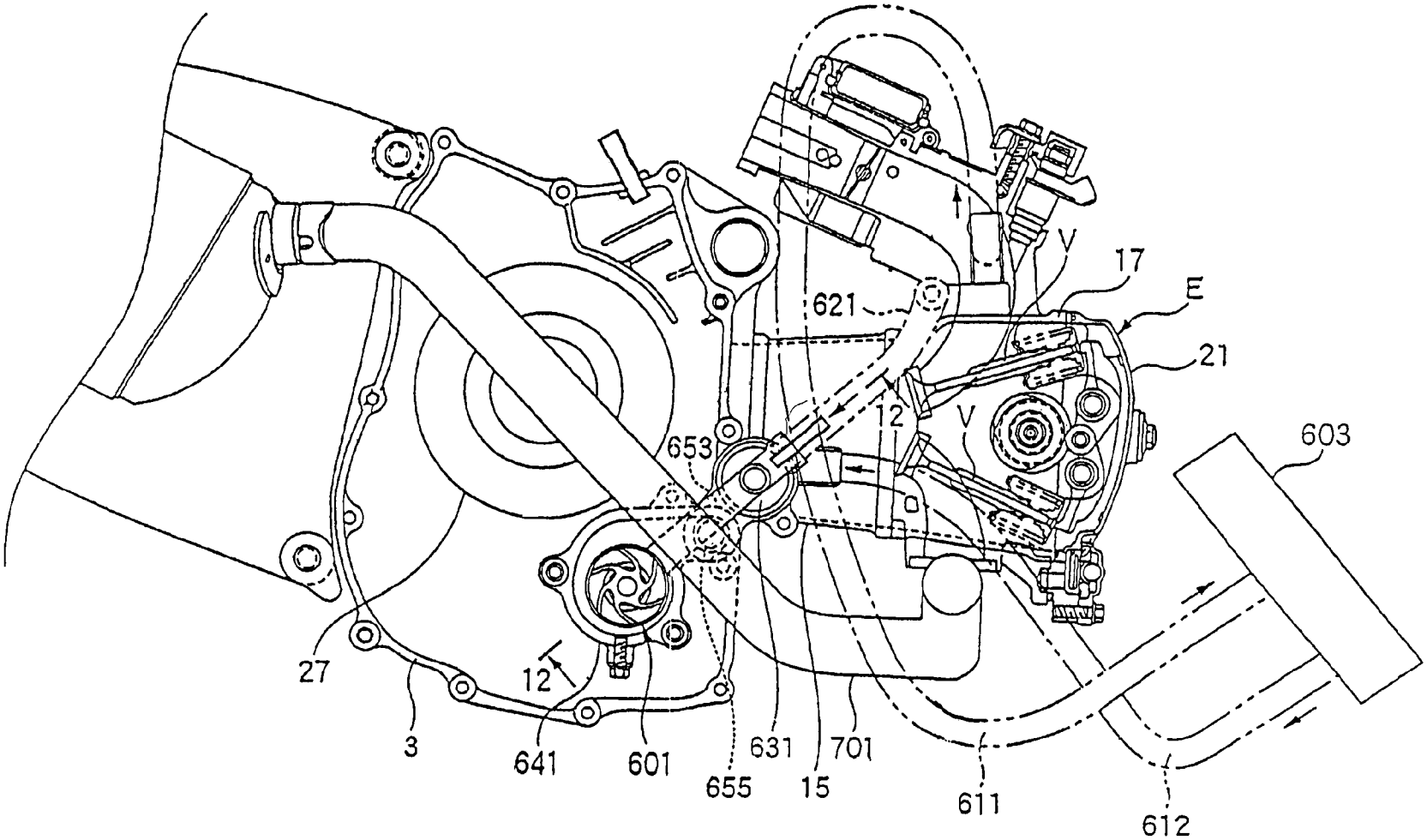
FIG. 11 is an enlarged view of the cooling structure viewed from the right side of the vehicle body, showing the exhaust pipe passing below the thermostat.

As shown in FIGS. 10 and 11, the second cooling structure 600 provided to the engine E includes a water pump 601 which pumps the coolant to the water jacket 171, 172 of the engine E. The second cooling structure 600 includes main circulation channels 611, 612 for returning the coolant which has passed through the water jacket 171, 172 to the water pump 601 through a radiator 603, and a bypass channel 621 for returning the coolant which has passed through the water jacket 171, 172 to the water pump 601 not through the radiator 603. The second cooling structure 600 also includes a thermostat 631 which switches the channel for returning the coolant to the water pump 601 between the main circulation channel 612 and the bypass channel 621 according to the temperature of the coolant, the thermostat being provided at a position close to the water pump 601.

Figure 12:
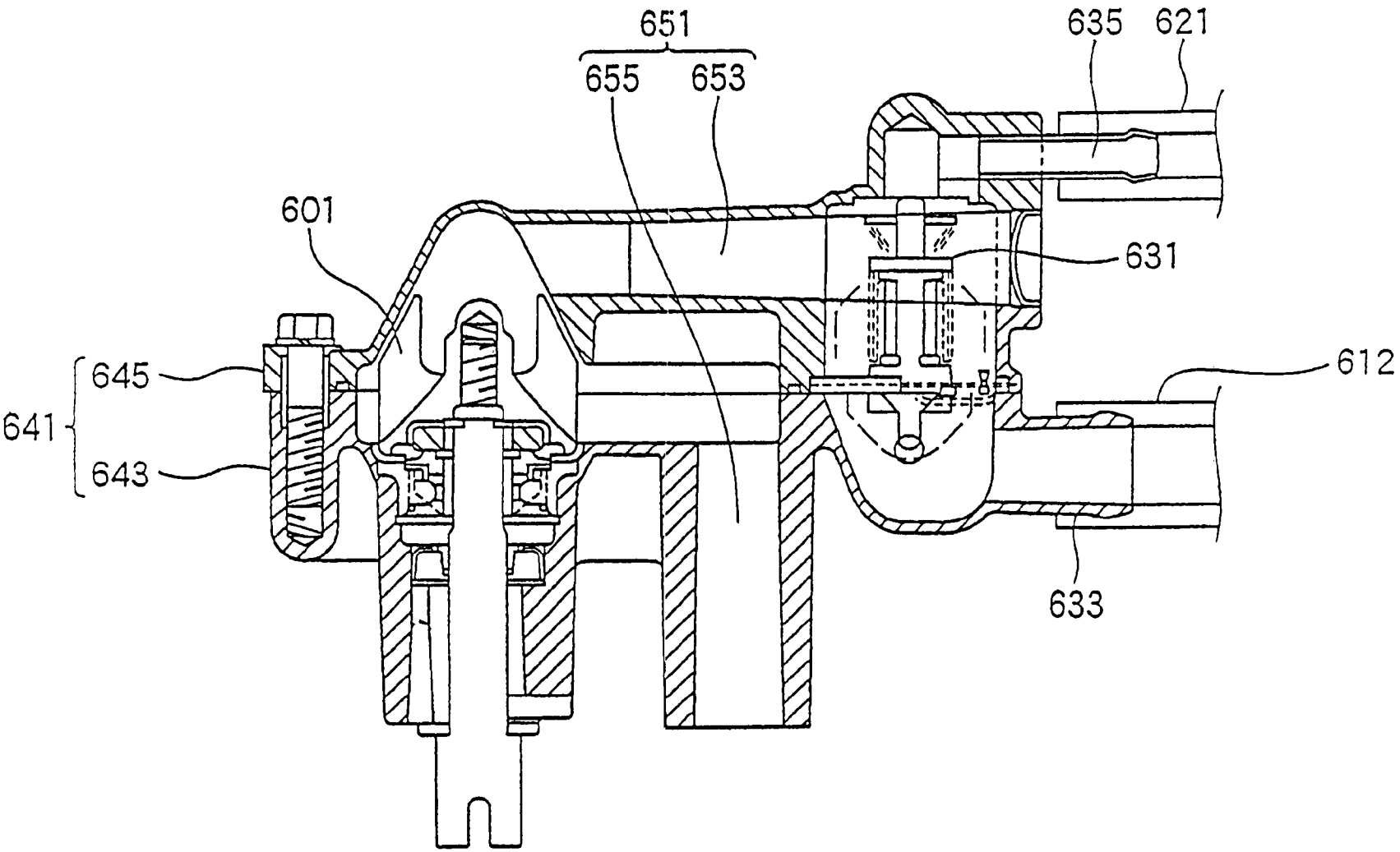
FIG. 12 is a cross-sectional view of a water pump and a thermostat shown in FIG. 11, taken along line 12—12, showing the coolant passage formed within the cover member.
Figure 13:
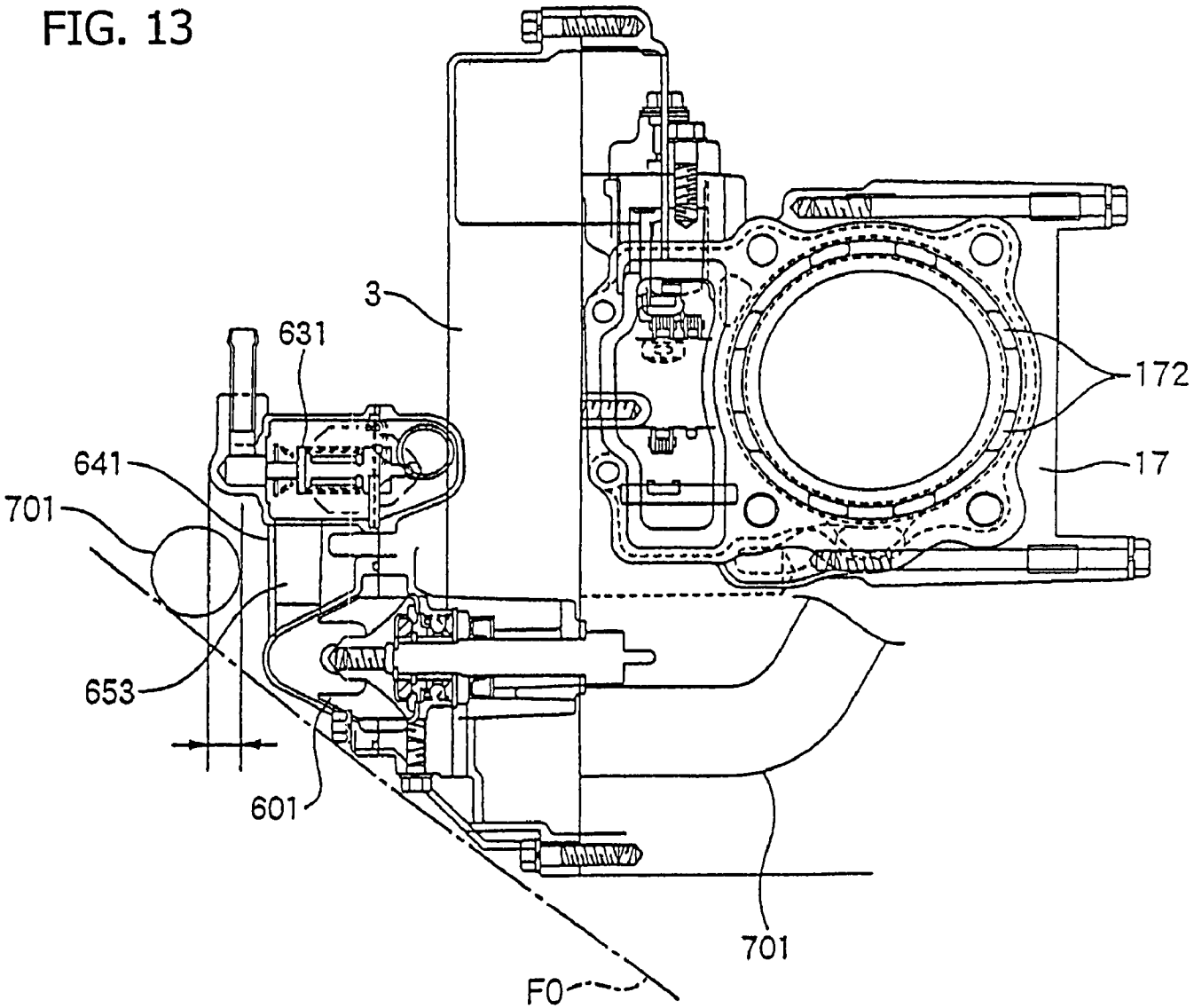
FIG. 13 is an illustration of arrangement of the water pump and the thermostat, and banking angle, viewed from the front of the vehicle body.

In this embodiment, as shown in FIGS. 11 to 13, the water pump 601 and the thermostat 631 are provided on a cover member 641 which is installed on the outside of the crankcase 3 of the engine E. The cover member 641 has a configuration including a base 643 connected to the crankcase 3, and a lid body 645 covering the top of the base 643. The water pump 601 and the thermostat 631 are retained between the base 643 and the lid body 645. In addition, a coolant passage 651, which communicates with the water jacket 171, 172 through the water pump 601 from the thermostat 631, is integrally formed in the cover member 641, so that the coolant discharged from the water pump 601 is pumped to the water jacket 171, 172 through the coolant passage 651.

In the case of this embodiment, as shown in FIGS. 8 and 11, the water pump 601 is disposed on the second end side of the crankshaft 1 on which the generator a is provided such that the water pump is disposed below the generator a. As shown in FIG. 12, the coolant passage 651, integrally formed in the cover member 641, is composed of a first passage 653, which permits the thermostat 631 to communicate with the suction port of the water pump 601, and a second passage 655, which permits the discharge port of the water pump 601 to communicate with the water jacket 171, 172. As is apparent from FIG. 11, the water pump 601 is disposed below and to the front, in terms of the vehicle body, of the crankshaft 1 of the engine E. In addition, the thermostat 631 is disposed above and to the front, in terms of the vehicle body, of the water pump 601. In addition, as shown in FIG. 12, the first passage 653 is so disposed that the first passage 653 lies substantially orthogonally with respect to with the second passage 655 when viewed from the side, and the respective axes of the water pump 601 and the thermostat 631 are in parallel with each other.

The thermostat 631 is provided with a main circulation channel connection port 633. The main circulation channel 612, through which the coolant is returned from the radiator 603, is connected to the main circulation channel connection port 633. The thermostat 631 is also provided with a bypass connection port 635, to which the bypass passage 621 is connected. When the temperature of the coolant is below a set temperature, the thermostat 631 closes the main circulation channel connection port 633 and permits the bypass connection port 635 to communicate with the first passage 653. When the temperature of the coolant is equal to or above the set temperature, the thermostat 631 closes the bypass connection port 635, and allows the main circulation channel connection port 633 to communicate with the first passage 653.

Figure 6:
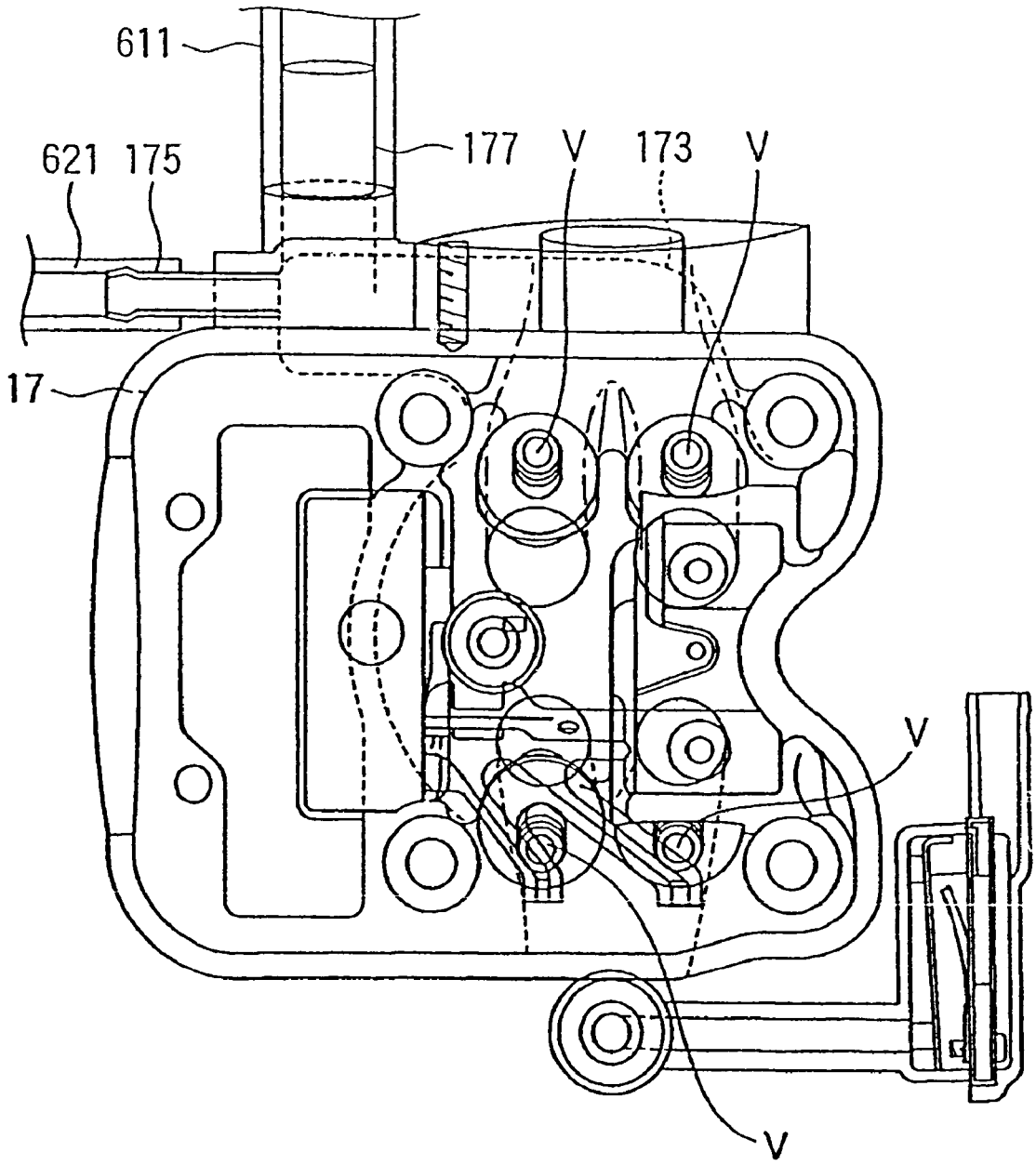
FIG. 6 is a cross-sectional view taken along line 6—6 of FIG. 4 showing the cylinder head as viewed from the front of the vehicle showing the position of the coolant channels with respect to the cylinder head and the valves therein.

In FIG. 6, a channel 173 shown by a broken line is a channel for returning the coolant, which communicates with the water jacket 171, 172. The channel 173 is provided with a bypass connection port 175 for connecting the channel to the bypass connection port 635 of the thermostat 631 through the bypass channel 621, and a main circulation channel connection port 177 for connecting the channel to the radiator 603 through the main circulation channel 611.

In the case of this embodiment, as shown in FIGS. 11 and 13, an exhaust pipe 701 extending from the cylinder head 17 of the engine E is close to and substantially orthogonally overlies the first passage 653 when viewed from the vehicle side. Moreover, the exhaust pipe passes so as to underlie the thermostat 631 in the vertical direction, and is disposed in a position along a vehicle body lower surface F0, which is substantially parallel with the banking angle.

In the cooling structure 600 of the engine E described above, since the positions of the water pump 601 and the thermostat 631 for circulating the coolant have been moved to the outside of the crankcase 3 of the engine E, where it is easy to secure the mounting space, the space occupied by the cooling structure 600 is made compact. Accordingly, as compared to the conventional cooling structure, in which the water pump and the thermostat are disposed on a side of the cylinder head, the cooling structure 600 can increase the degree of freedom of layout around the cylinder head by keeping the projection amount on the side of the cylinder head small.

Moreover, in the above-described cooling structure 600, the water pump 601 and the thermostat 631 are provided to the cover member 641 installed on the outside of the crankcase 3 of the engine E. In addition, the coolant passage 651, which communicates with the water jacket 171, 172 through the water pump 601 from the thermostat 631, is integrally formed in the cover member 641. Thus, the need for the work of, for example, connecting a pipe or the like to be the coolant channel to the water pump 601 inside the cover member 641 is eliminated, piping construction is uncomplicated, and the number of assembly steps is reduced.

In addition, in the case of the engine for the motorcycle, as shown in FIG. 3, many components for changing speed are installed on the transmission 100 side thereof, the transmission 100 being connected to a first end of the crankshaft 1, and it is therefore difficult to preserve room therearound. In comparison with this, the generator a connected on the second end of the crankshaft 1 is small as compared to the transmission 100, and space is therefore available in the vicinity thereof, particularly therebelow. In other words, in the above-described cooling structure 600, the room below the generator $\alpha$ is effectively utilized as a space for disposing the water pump 601, and thus the cooling structure 600 is efficiently arranged in terms of space.

In addition, with the above-described cooling structure 600, the first and second passages 653, 655 of the coolant passage 651 are arranged compactly, and thus the enlargement of the cover member 641 is prevented, the amount of space occupied is reduced.

Moreover, with the above-described cooling structure 600, the water pump 601, the thermostat 631, and the like do not interfere with the layout of the exhaust pipe 701, and it is possible to place the exhaust pipe 701 so that it does not affect the banking angle of the vehicle body. Thus, the layout design of the exhaust pipe 701 is simplified.

While a working example of the present invention has been described above, the present invention is not limited to the working example described above, but various design alterations may be carried out without departing from the present invention as set forth in the claims.

What is claimed is:

1. An engine provided with a cooling structure, the engine comprising:

a casting having a water jacket formed therein and surrounding a portion of the engine;

a radiator;

a water pump for pumping coolant to the water jacket of the engine;

a main circulation channel for returning the coolant which has passed through the water jacket to the water pump through the radiator;

a bypass channel for returning the coolant which has passed through the water jacket to the water pump not through the radiator; and a thermostat which is operable to switch the operative channel for returning the coolant to the water pump, between the main circulation channel and the bypass channel according to coolant temperature, the thermostat being provided at a position close to the water pump, and a cover member installed on an outside of the engine crankcase, the cover member having a coolant passage formed therein which communicates with the water jacket through the water pump;

wherein the water pump and the thermostat are operatively attached to the cover member, and;

wherein the cover member is configured such that coolant discharged from the water pump is pumped to the water jacket through the coolant passage of the cover member without passing external to the engine.

2. The engine cooling structure according to claim 1, wherein the engine further comprises a crankshaft rotatably supported by the crankcase, a generator for generating electricity by rotation of the crankshaft, and a transmission for transmitting power from the engine to a driving wheel, wherein the transmission is disposed on a first end of the crankshaft, and the generator is disposed on a second end of the crankshaft opposite the first end, and wherein the water pump is disposed below the generator at the second end of the crankshaft.

3. The engine cooling structure according to claim 1, wherein the water pump comprises an intake port and a discharge port, wherein the coolant passage is composed of a first passage, which permits the thermostat to communicate with the intake port of the water pump, and a second passage, which permits a discharge port of the water pump to communicate with the water jacket, and wherein the first passage is so disposed that the first passage overlaps the second passage when viewed from the side.

4. A vehicle, comprising:

a vehicle body;

an engine comprising the engine cooling structure according to claim 3, wherein the engine is mounted in the vehicle body so as to provide power thereto, and wherein the water pump is disposed below and forward of the engine crankshaft, and the thermostat is disposed above and forward of the water pump, in terms of the vehicle body.

5. The engine cooling structure according to claim 3, wherein the engine is mounted in a vehicle so as to provide power thereto, the vehicle comprising a vehicle body, and wherein an exhaust pipe extending from the engine is close to and overlaps the first passage when viewed from the side of the vehicle, overlaps the thermostat in the vertical direction, and is disposed in a position along a lower surface of the vehicle body, the lower surface of the vehicle being substantially parallel with a banking angle of the vehicle.

6. The engine cooling structure according to claim 1, wherein the engine further comprises a crankshaft rotatably supported by the crankcase, a generator generating electricity by rotation of the crankshaft, and a transmission for transmitting power from the engine to a driving wheel, wherein the transmission is disposed on a first end of the crankshaft, and the generator is disposed on a second end of the crankshaft, the second end opposed to the first end, wherein the engine cooling structure further comprises a lubricant cooling structure, the lubricant cooling structure comprises an oil pump actuated by the crankshaft, and pumping lubricant to the crankshaft via at least one oil supply passage, and wherein the water pump and the oil pump are disposed on the crankcase at said second end of the crankshaft so as to lie below the generator, and the oil pump is disposed at a location between the water pump and a center of the engine.

7. The engine cooling structure according to claim 1, wherein the water pump comprises an intake port and a discharge port, wherein the coolant passage is composed of a first passage, which permits the thermostat to communicate with the intake port of the water pump, and a second passage, which permits a discharge port of the water pump to communicate with the water jacket, and wherein the first and second passages are disposed so that the first passage is orthogonal to the second passage.

8. The engine cooling structure according to claim 1, wherein the thermostat lies in parallel with the water pump.

9. An engine cooling structure for an engine, the engine comprising a crankcase, the engine cooling structure comprising a water jacket surrounding at least a portion of the engine;

a radiator;

a water pump pumping coolant to the water jacket of the engine;

a plurality of channels permitting coolant flow between the water pump, the water jacket and the radiator; and a thermostat which selects a channel from the plurality of channels based on coolant temperature, wherein the water pump and the thermostat are provided on an outside of the crankcase of the engine, and wherein the engine further comprises a crankshaft rotatably supported by the crankcase, a generator generating electricity by rotation of the crankshaft, and a transmission for transmitting power from the engine, wherein the transmission is disposed on a first end of the crankshaft, and the generator is disposed on a second end of the crankshaft, the second end opposed to the first end, and the water pump is disposed at said second end of the crankshaft so as to lie below the generator.

10. The engine cooling structure of claim 9, wherein a cover member covers a portion of the crankcase, and wherein a coolant passage, which communicates with the water jacket through the water pump from the thermostat via the plurality of channels, is integrally formed in the cover member, and the coolant discharged from the water pump is pumped to the water jacket through the coolant passage.

11. The engine cooling structure according to claim 10, wherein the water pump comprises an intake port and a discharge port, wherein the coolant passage is composed of a first passage, which permits the thermostat to communicate with the intake port of the water pump, and a second passage, which permits a discharge port of the water pump to communicate with the water jacket, and wherein the first passage is so disposed that the first passage overlaps the second passage when viewed from the side.

12. The engine cooling structure according to claim 10, wherein the engine is mounted in a vehicle so as to provide power thereto, the vehicle comprising a vehicle body, and wherein an exhaust pipe extending from the engine is close to and overlaps the coolant passage when viewed from the side of the vehicle, overlaps the thermostat in the vertical direction, and is disposed in a position along a lower surface of the vehicle body, the lower surface of the vehicle being substantially parallel with a banking angle of the vehicle.

13. The engine cooling structure according to claim 10, wherein the water pump comprises an intake port and a discharge port, wherein the coolant passage is composed of a first passage, which permits the thermostat to communicate with the intake port of the water pump, and a second passage, which permits a discharge port of the water pump to communicate with the water jacket, and wherein the first passage is so disposed that the first passage is orthogonal to the second passage.

14. The engine cooling structure according to claim 10, wherein the thermostat lies in parallel with the water pump.

15. The engine cooling structure according to claim 9, wherein the engine is mounted in a vehicle so as to provide power thereto, the vehicle comprising a vehicle body, and wherein the water pump is disposed below and to the front, in terms of the vehicle body, of the crankshaft of the engine, and the thermostat is disposed above and to the front, in terms of the vehicle body, of the water pump.

16. An engine cooling structure for cooling an engine, said cooling structure comprising:

a water jacket formed surrounding a portion of the engine;

a radiator;

a crankcase;

a water pump for pumping coolant to the water jacket of the engine;

a main circulation channel for returning the coolant which has passed through the water jacket to the water pump through the radiator;

a bypass channel for returning the coolant which has passed through the water jacket to the water pump not through the radiator;

a thermostat operable to switch between the main circulation channel and the bypass channel according to temperature of the coolant received from the water jacket, the thermostat being provided at a position close to the water pump;

a cover member installed on the crankcase, the cover member having a coolant passage integrally formed therein which communicates with the water jacket through the water pump;

a crankshaft rotatably supported by the crankcase, said crankshaft having a first end and a second end opposed to the first end; and a transmission disposed on the first end of the crankshaft, and a generator disposed on a second end of the crankshaft;

wherein the water pump and the thermostat are operatively attached to the cover member, and;

wherein the cover member is configured to extend the coolant passage into the engine such that coolant discharged from the water pump is pumped to the water jacket through the coolant passage independent of any external connection therebetween.

17. An engine cooling structure according to claim 16, further comprising a lubricant cooling structure, the lubricant cooling structure having an oil pump actuated by the crankshaft, and pumping lubricant to the crankshaft via at least one oil supply passage, and wherein the water pump and the oil pump are disposed on the crankcase at the second end of the crankshaft so as to lie below the generator, and the oil pump is disposed at a location between the water pump and a center of the engine.

18. An engine cooling structure according to claim 16, wherein the thermostat lies in parallel with the water pump.

19. An engine cooling structure according to claim 16, wherein the water pump comprises an intake port and a discharge port, wherein the coolant passage is composed of a first passage, which permits the thermostat to communicate with the intake port of the water pump, and a second passage, which permits a discharge port of the water pump to communicate with the water jacket, and wherein the first passage is so disposed that the first passage overlaps the second passage when viewed from the side.

20. An engine cooling structure according to claim 16, wherein the engine is mounted in a vehicle so as to provide power thereto, the vehicle comprising a vehicle body, and wherein an exhaust pipe extending from the engine is close to and overlaps the first passage when viewed from the side of the vehicle, overlaps the thermostat in the vertical direction, and is disposed in a position along a lower surface of the vehicle body, the lower surface of the vehicle being substantially parallel with a banking angle of the vehicle.

* * * * *